US007455054B2

(12) United States Patent
Oh et al.

(10) Patent No.: US 7,455,054 B2
(45) Date of Patent: Nov. 25, 2008

(54) CANISTER WITH FUEL GAS REDUCING DEVICE

(75) Inventors: Won Suk Oh, Seoul-si (KR); Ki Kyung Bea, Anseong-si (KR); Hyun Ki Kim, Pyeongtaek-si (KR); Kyoo Kang Sim, Anseong-si (KR)

(73) Assignee: Korea Fuel-Tech Corporation, Ansung-si, Gyeonggi-do (KR)

( * ) Notice: Subject to any disclaimer, the term of this patent is extended or adjusted under 35 U.S.C. 154(b) by 0 days.

(21) Appl. No.: 11/854,051

(22) Filed: Sep. 12, 2007

(65) Prior Publication Data

US 2008/0110440 A1 May 15, 2008

(30) Foreign Application Priority Data

Nov. 14, 2006 (KR) ..... 10-2006-0112217

(51) Int. Cl.
*F02M 33/04* (2006.01)
*F02M 33/02* (2006.01)

(52) U.S. Cl. ..... 123/519; 123/520

(58) Field of Classification Search ..... 123/519, 123/520, 518, 516, 573, 198 D
See application file for complete search history.

(56) References Cited

U.S. PATENT DOCUMENTS

| | | | | |
|---|---|---|---|---|
| 5,207,808 | A * | 5/1993 | Haruta et al. | 96/131 |
| 6,955,159 | B2 * | 10/2005 | Ogawa | 123/519 |
| 6,959,698 | B2 * | 11/2005 | Ikuma et al. | 123/519 |
| 7,159,579 | B2 * | 1/2007 | Meiller et al. | 123/518 |
| 2002/0020398 | A1 * | 2/2002 | Kimoto et al. | 123/519 |
| 2004/0007135 | A1 * | 1/2004 | Ikuma et al. | 96/135 |
| 2004/0206240 | A1 * | 10/2004 | Oh et al | 96/135 |
| 2004/0261777 | A1 * | 12/2004 | Ogawa | 123/698 |
| 2007/0119306 | A1 * | 5/2007 | Yamada et al. | 96/131 |

FOREIGN PATENT DOCUMENTS

| | | |
|---|---|---|
| KR | 10 20010036538 | 5/2001 |
| KR | 10 20030089139 | 11/2003 |
| KR | 10 20040017053 | 2/2004 |
| KR | 1020040090740 | 10/2004 |

* cited by examiner

*Primary Examiner*—Mahmoud Gimie
(74) *Attorney, Agent, or Firm*—Michael J. Striker

(57) ABSTRACT

A canister for a motor vehicle is connected to a fuel tank and a throttle pipe to adsorb fuel gas containing noxious constituents, which are generated in a fuel tank. A first space and a second space, through which the fuel gas flows, are defined, the fuel gas flows in opposite directions through the respective first and second spaces, the second space is divided into space parts by a plurality of support filters, a fuel gas reducing device is installed in one space part, which is delimited by two support filters, and air flow through the fuel gas reducing device is perpendicular to air flow through the first and second spaces.

5 Claims, 10 Drawing Sheets

CANISTER WITH FUEL GAS REDUCING DEVICE

BACKGROUND OF THE INVENTION

1. Field of the Invention

The present invention relates to a canister applied to a motor vehicle to reduce the discharge of fuel gas and, more particularly, to a canister for a motor vehicle which can significantly reduce the amount of discharged fuel gas.

2. Description of the Prior Art

As is well known in the art, a motor vehicle has a device for storing fuel gas generated in a fuel tank and then supplying the fuel gas to an engine. This device is commonly called a canister.

In general, fuel to be used for driving the engine is stored in a fuel tank. In the fuel tank, as the fuel vaporizes due to environmental factors such as the surrounding temperature, fuel gas is generated. Because the fuel gas contains noxious constituents, if the noxious constituents are discharged out of the motor vehicle, air pollution and waste of fuel result.

In the canister, while the engine is stopped, the fuel gas generated in the fuel tank is adsorbed and stored by activated charcoal, and then, when the engine is started, the stored fuel gas is supplied to the engine, whereby air pollution and the waste of fuel are prevented. This type of canister has been disclosed in Korean Unexamined Patent Publication Nos. 2004-90740, 2004-17053, 2003-89139 and 2001-36538.

FIG. 1 is a systematic view schematically illustrating the connection between a canister 1 and a fuel tank 2.

Referring to FIG. 1, an inlet pipe 3 of the canister 1 communicates with the fuel tank 2. With the engine stopped, the fuel gas generated in the fuel tank 2 is introduced into the canister 1 through the inlet pipe 3 due to the internal pressure of the fuel tank.

Activated charcoal for adsorbing the fuel gas is charged in the canister 1. The fuel gas introduced into the canister 1 through the inlet pipe 3 is adsorbed by the activated charcoal. Of course, in this case, the remnant of the fuel gas, which is not adsorbed by the activated charcoal, is discharged to the atmosphere through an outlet pipe 4 which is connected to the canister 1.

The canister 1 and a throttle pipe 6 communicate with each other via a guide pipe 5. A control valve 7 is installed on the guide pipe 5 to control the flow of fuel gas from the canister 1 to the throttle pipe 6. The control valve 7 is closed with the engine stopped and is opened with the engine started.

When a driver starts the engine, air is supplied to the engine through the throttle pipe 6. In this state, since the internal pressure of the throttle pipe 6 is lower than atmospheric pressure, outside air is introduced into the throttle pipe 6 through the discharge pipe 4, the canister 1 and the guide pipe 5. At this time, the fuel gas which is adsorbed by the activated charcoal in the canister 1 is introduced into the throttle pipe 6 along with the air flow and is supplied to the engine.

The conventional canister suffers from a drawback as described below.

According to recent regulations limiting the discharge of fuel gas, that is, regulations mandating a PZEV (partial zero emission vehicle), the discharge of fuel gas must not exceed 0.35 g per gallon of fuel.

In this regard, the conventional canister encounters problems in that the inside structure thereof is not appropriate for accommodating various kinds of activated charcoal, and since the flow path of fuel gas is simple, fuel gas cannot be sufficiently adsorbed to the activated charcoal. That is to say, the conventional canister cannot satisfy the PZEV regulations due to its structure.

Further, in order to respond to these problems, while attempts have been made to separately attach a fuel gas reducing device capable of reducing fuel gas outside the canister, in this case, a problem is caused in that, since the fuel gas reducing device, which is expensive, must be added, the manufacturing cost of the motor vehicle markedly increases.

SUMMARY OF THE INVENTION

Accordingly, the present invention has been made keeping in mind the above problems occurring in the prior art, and provides a canister for a motor vehicle which can significantly reduce the amount of discharged fuel gas.

In an aspect, the present invention provides a canister for a motor vehicle, connected to a fuel tank and a throttle pipe to adsorb fuel gas containing noxious constituents, which are generated in a fuel tank, wherein a first space and a second space, through which the fuel gas flows, are defined, the fuel gas flows in opposite directions through the respective first and second spaces, the second space is divided into space parts by a plurality of support filters, a fuel gas reducing device is installed in one space part, which is delimited by two support filters, and air flow through the fuel gas reducing device is perpendicular to air flow through the first and second spaces.

According to another aspect of the present invention, activated charcoal is charged in the fuel gas reducing device.

According to another aspect of the present invention, the ingredients of the activated charcoal, which is charged in the fuel gas reducing device, are different from those of activated charcoal, which is charged in the first and second spaces.

According to another aspect of the present invention, BWC (Butane Working Capacity) activated charcoal is charged in the fuel gas reducing device.

According to still another aspect of the present invention, the fuel gas reducing device has a fuel gas reducing block, which is filled with the activated charcoal, and a bracket for holding the fuel gas reducing block, the fuel gas reducing block has windows for air flow on opposite sides thereof, and the bracket has upper and lower horizontal plates which are formed to be long in opposite directions.

According to a still further aspect of the present invention, the activated charcoal is charged in the fuel gas reducing block.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
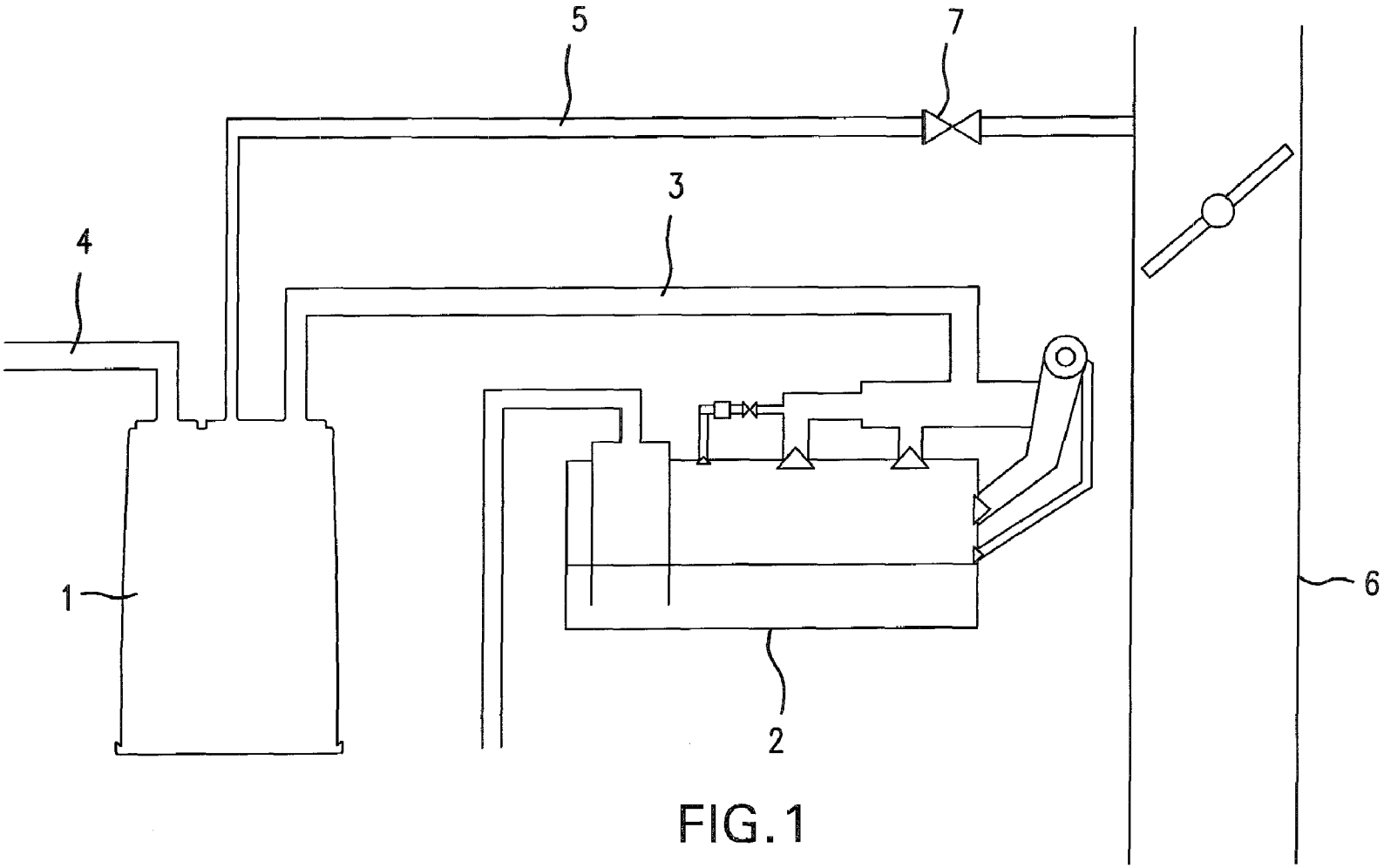
FIG. 1 is a schematic view illustrating the connection between a canister and a fuel tank.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
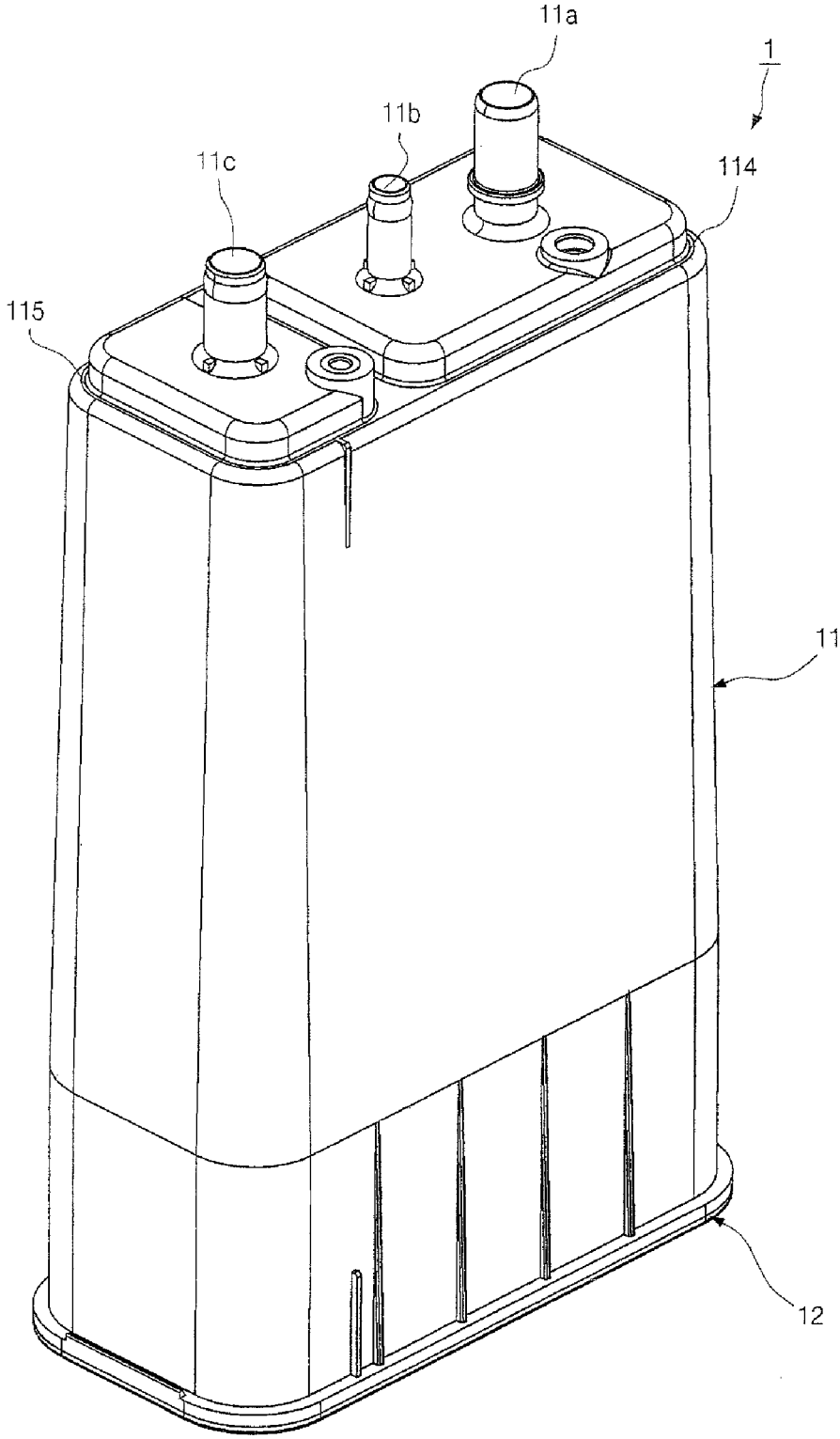
FIG. 2 is a perspective view of a canister with a fuel gas reducing device in accordance with an embodiment of the present invention.
Figure 3:
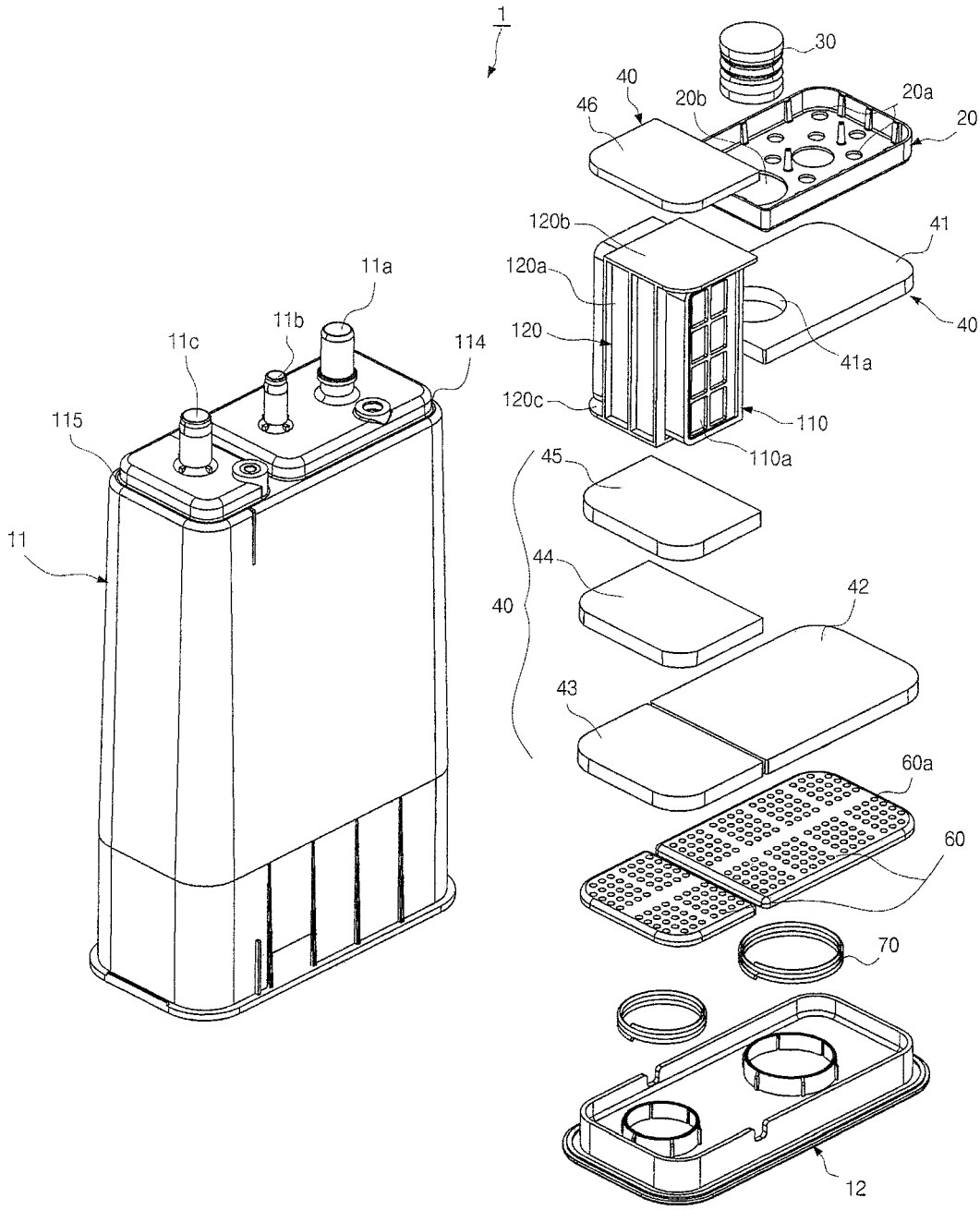
FIG. 3 is an exploded perspective view of the canister with a fuel gas reducing device shown in FIG. 2.
Figure 4:
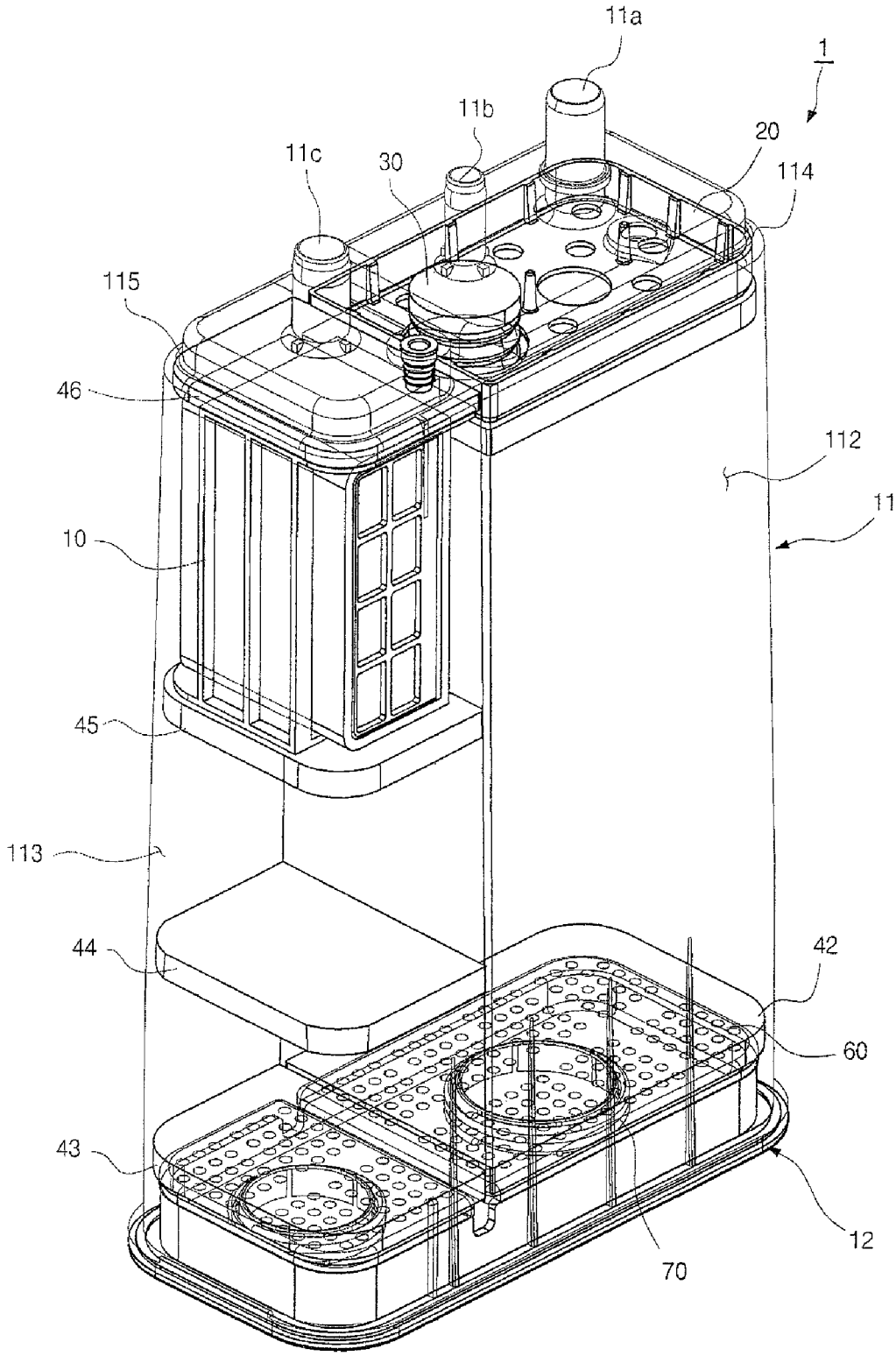
FIG. 4 is a projection view of the canister with a fuel gas reducing device shown in FIG. 2.
Figure 5:
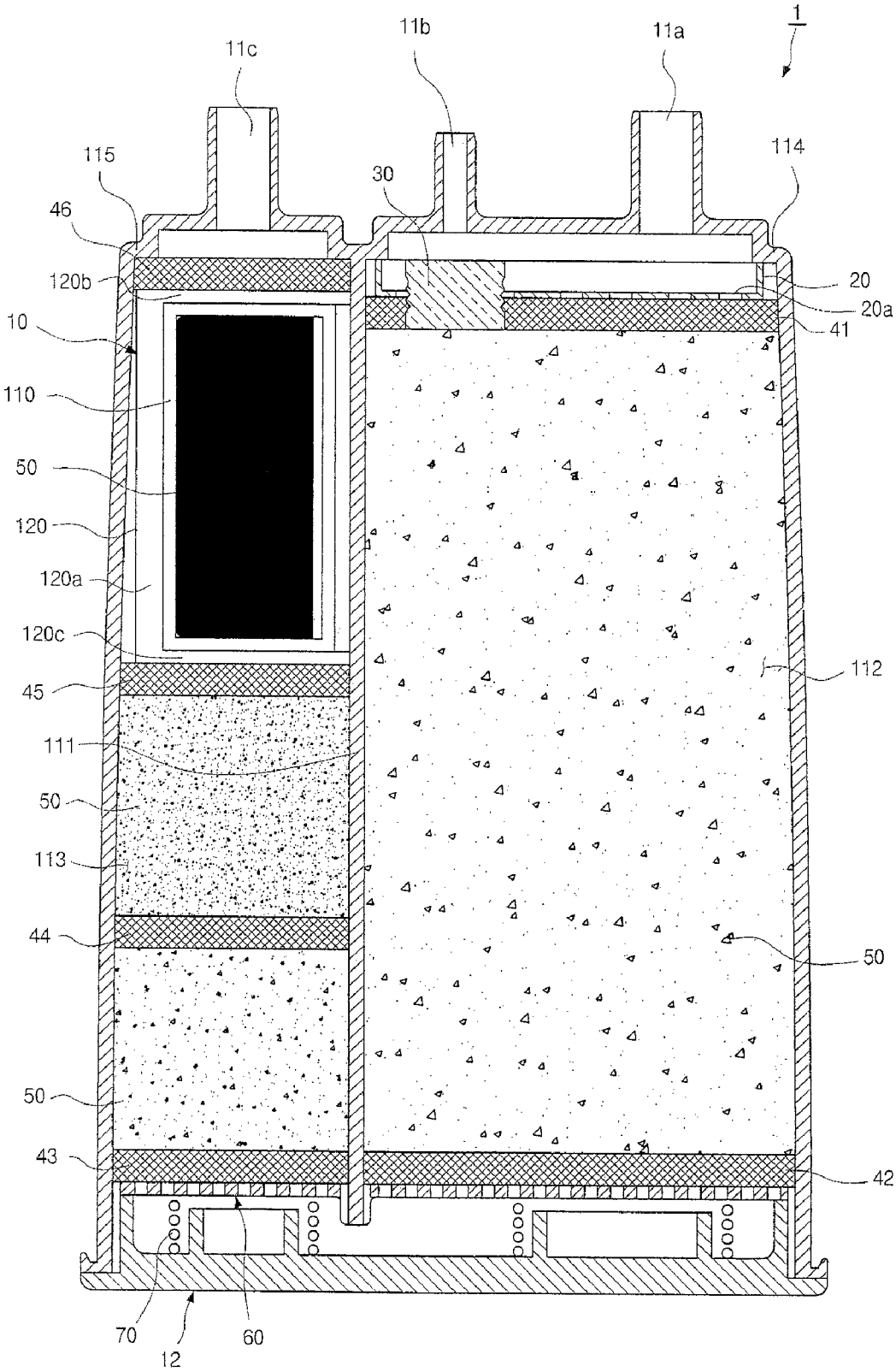
FIG. 5 is a cross-sectional view of the canister with a fuel gas reducing device shown in FIG. 2.

FIGS. 2 through 5 illustrate a canister 1 with a fuel gas reducing device 10 in accordance with an embodiment of the present invention, wherein FIG. 2 is a perspective view, FIG. 3 is an exploded perspective view, FIG. 4 is a projection view, and FIG. 5 is a cross-sectional view.

The canister 1 includes a canister body 11 and a bottom plate 12 which is coupled to the lower end of the canister body 11. In the canister body 11, a fuel gas reducing device 10, a diffusion trap 20, a purge filter 30, a support filter 40, activated charcoal 50, a strainer 60, and elastic members 70 are disposed.

The canister body 11 is open at the lower end thereof and has a trapezoidal shape which is gradually narrow from the lower end to the upper end thereof.

A vertical partition wall 111 is formed in the canister body 11 to divide the inside space of the canister 11 along the vertical direction into two spaces, that is, a first space 112 and a second space 113. A tank port 11*a* for the introduction of the fuel gas generated in a fuel tank 2 (see FIG. 1) and a purge port 11*b* for the discharge of adsorbed fuel gas into a guide pipe 5 are provided to the upper end of the first space 112. An air port 11*c* for the suction and discharge of air is provided at the center portion on the upper end of the second space 113.

An air gap 114 is formed in the upper end of the canister body 11 which corresponds to the first space 112, and the diffusion trap 20 is arranged below the air gap 114. The diffusion trap 20 has the shape of a rectangular block which is open at the upper end thereof, and a plurality of holes 20*a* is defined through the bottom of the diffusion block 20. A fastening hole 20*b* for mounting the purge filter 30 is defined through the bottom of the diffusion block 20 at a position which corresponds to the purge port 11*b*.

The air gap 114 and the diffusion trap 20 function to allow the fuel gas, introduced into the canister 1 through the tank port 11*a*, to pass through the layer of the activated charcoal 50 over as wide a range as possible.

A first support filter 41 is arranged below the diffusion trap 20. A hole 41*a* is defined through the first support filter 41 to correspond to the mounting position of the purge filter 30. The first support filter 41 functions to prevent the activated charcoal 50 charged in the first space 112 from being released to the outside.

The purge filter 30 has a cylindrical configuration and is formed of non-woven fabric, etc. The purge filter 30 functions to filter fine dust etc. from the fuel gas which is supplied into an engine room through the purge port 11*b*.

Also, a second support filter 42 is arranged adjacent to the lower end of the first space 112. The activated charcoal 50 is charged between the first and second support filters 41 and 42. Here, for example, 2GK-N is used as the activated charcoal 50. Like the first support filter 41, the second support filter 42 functions to prevent the activated charcoal 50 charged in the first space 112 from being released to the outside.

A third support filter 42 for preventing the activated charcoal 50 from being released to the outside is arranged adjacent to the lower end of the second space 113. The strainer 60 is installed below the second and third support filters 42 and 43 to entirely support the activated charcoal 50 which is charged in the first and second spaces 112 and 113. The strainer 60 is elastically supported relative to the bottom plate 12 by the elastic members 70.

The second space 113 is divided into a plurality of space parts by third through sixth support filters 43 through 46. Here, for example, 2GK-N activated charcoal 50 is charged between the third and fourth support filters 43 and 44, and, for example, BAX1110 activated charcoal 50 is charged between the fourth and fifth support filters 44 and 45. The fuel gas reducing device 10 is mounted between the fifth and sixth support filters 45 and 46. The filling positions of the 2GK-N and the BAX1110, used as the activated charcoal 50, and the mounting position of the fuel gas reducing device 10 can be changed among the space parts which are divided by the third through sixth support filters 43 through 46.

The sixth support filter 46 is installed to be spaced apart from the air port 11*a* due to the presence of an air gap 115 which is formed in the upper end of the canister body 11. This is to ensure that the suction and discharge of air through the air port 11*c* can easily occur.

Figure 6:
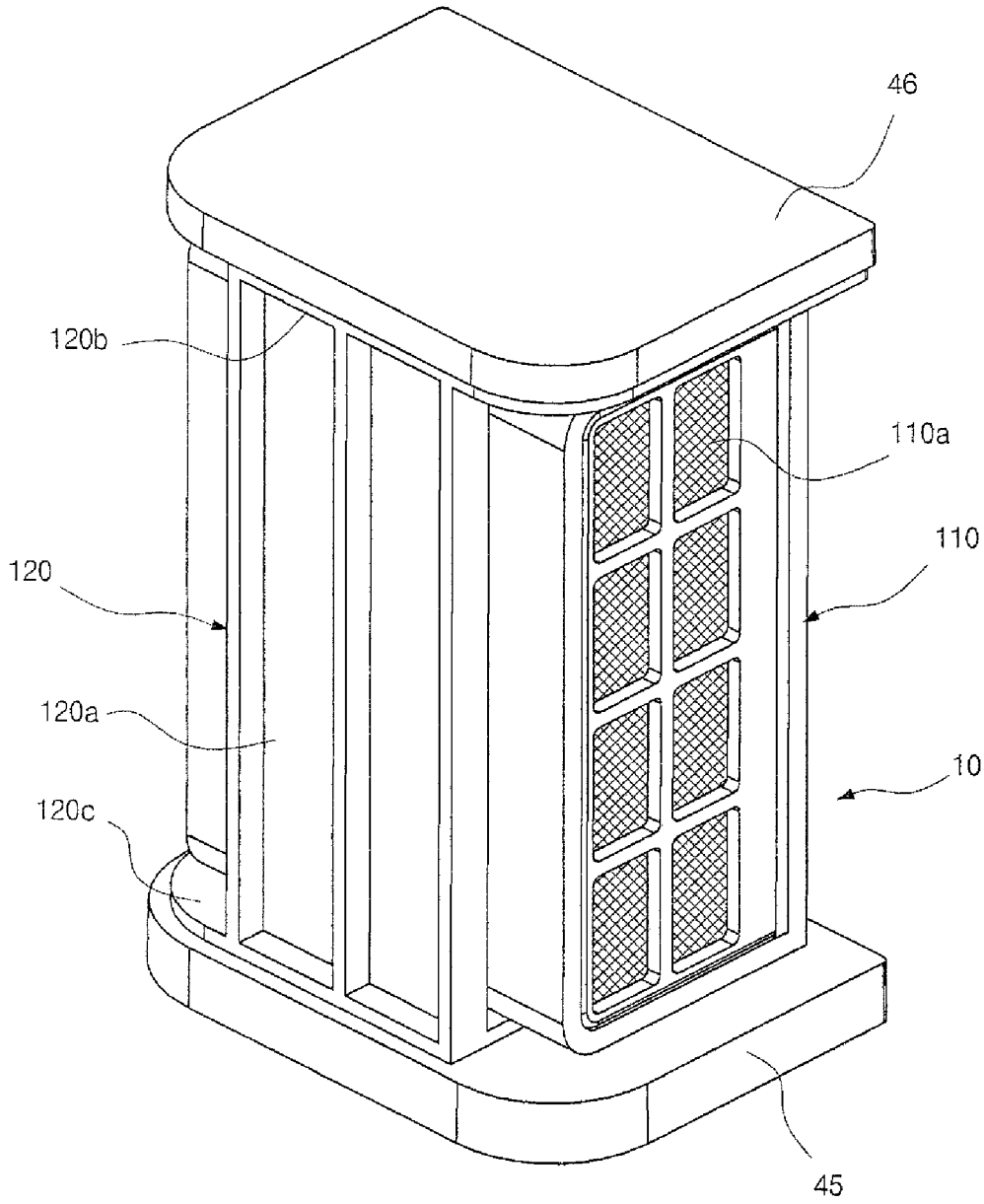
FIG. 6 is a perspective view of a fuel gas reducing device.
Figure 7:
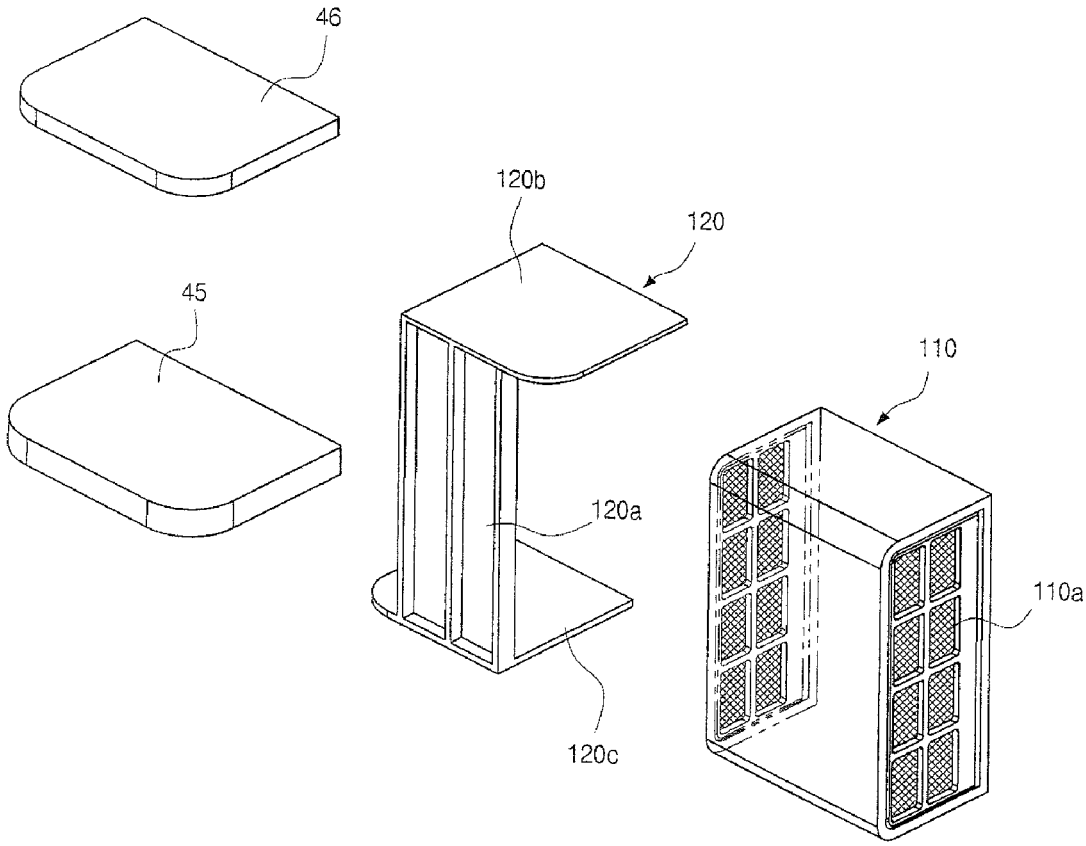
FIG. 7 is an exploded perspective view of the fuel gas reducing device.

FIG. 6 is a perspective view illustrating the outer appearance of the fuel gas reducing device 10, and FIG. 7 is an exploded perspective view of the fuel gas reducing device 10.

The fuel gas reducing device 10 includes a fuel gas reducing block 110 and a bracket 120 for holding the fuel gas reducing block 110.

The fuel gas reducing block 110 has windows 110*a* for allowing air flow on opposite sides thereof. The windows 110*a* are installed perpendicular to the flowing direction of the fuel gas in the canister body 11, that is, perpendicular to the flow path of the fuel gas which is introduced through the tank port 11*a* and discharged through the air port 11*c*. For example, BWC activated charcoal 50 is charged in the fuel gas reducing block 110.

The bracket 120 has a vertical plate 120*a* and upper and lower horizontal plates 120*b* and 120*c* which are integrally coupled to the vertical plate 120*a*. When viewed in its entirety, the bracket 120 has the shape of a clockwise 90° -rotated U. In particular, the upper horizontal plate 120*b* is formed to extend longer on one side thereof (the right side in the drawing) than the lower horizontal plate 120*c* in a manner such that the end thereof is brought into contact with one inner surface portion of the canister body 11, and the lower horizontal plate 120*c* is formed to extend longer on the other side thereof (the left side in the drawing) than the upper horizontal plate 120*b* in a manner such that the end thereof is brought into contact with another inner surface portion of the canister body 11.

According to this, the fuel gas, which has passed through the fifth support filter 45, flows through the space which is defined between the fuel gas reducing block 110 and one inner surface portion of the canister body 11, and is then introduced into the fuel gas reducing block 110 through one window 110*a* of the fuel gas reducing block 110. Thereafter, the air, which is discharged through the other window 110*a* of the fuel gas reducing block 110, flows upwards through the space which is defined between the fuel gas reducing block 110 and another inner surface portion of the canister body 11, and is then discharged into the air port 11*c* through the sixth support filter 46.

Further, outside air, which enters the canister body 11 through the air port 11*c*, passes through the sixth support filter 46; flows through the space which is defined between the fuel gas reducing block 110 and another inner surface portion of the canister body 11, and is then introduced into the fuel gas reducing block 110 through the other window 110*a* of the fuel gas reducing block 110. Thereafter, the air, which is discharged through one window 110*a* of the fuel gas reducing block 110, flows downwards through the space which is defined between the fuel gas reducing block 110 and one inner surface portion of the canister body 11, and then passes through the fifth support filter 45.

The sixth support filter 46 is arranged to be spaced apart from the air port 11*c* by a predetermined interval due to the presence of the air gap 115. This is to ensure that air flow through the air port 11*c* can easily occur.

Figure 8:
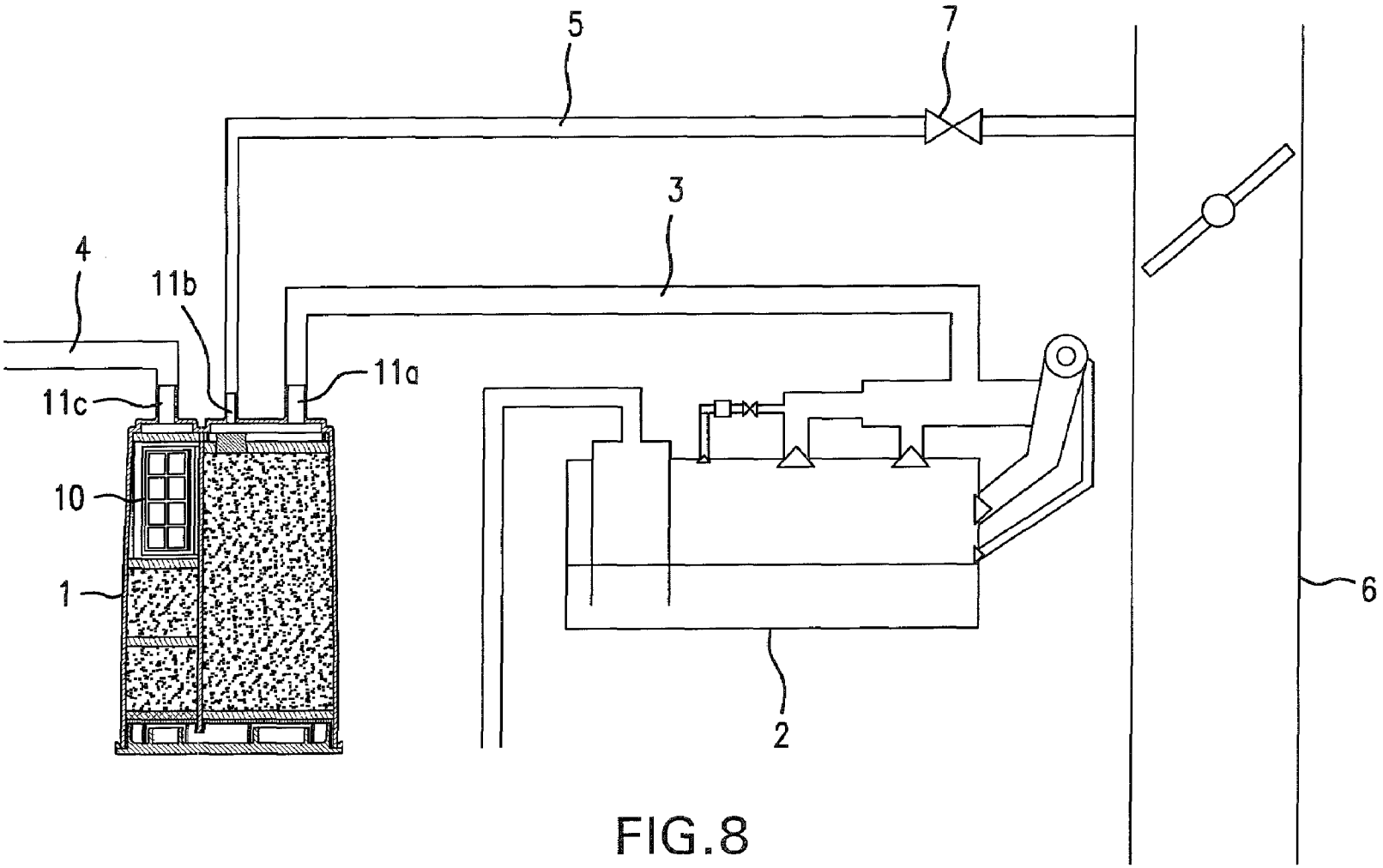
FIG. 8 is a view illustrating the use of the canister with a fuel gas reducing device.
Figure 9A:
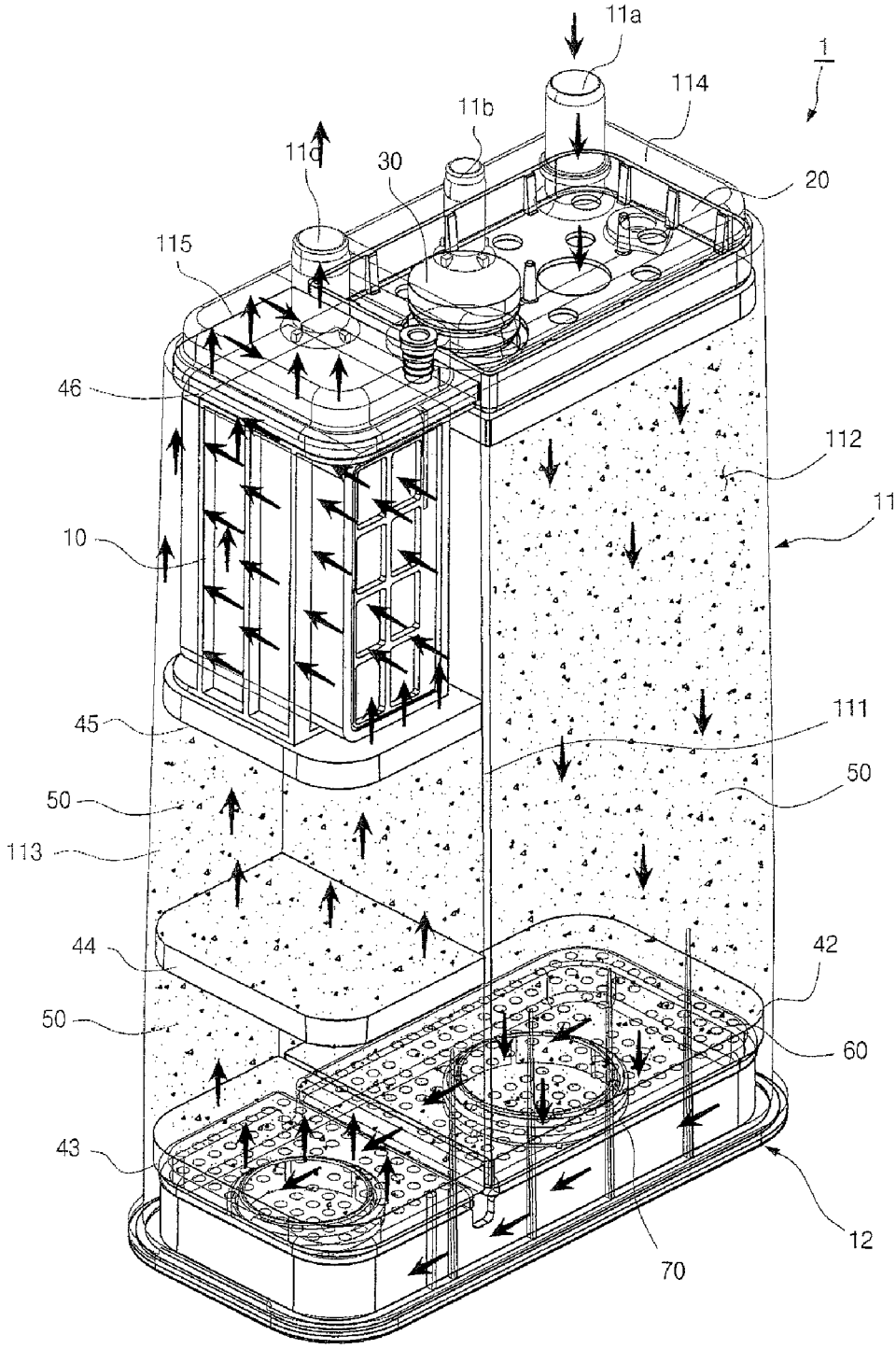
FIGS. 9A and 9B are projected perspective views illustrating the flow of fuel gas in the canister with a fuel gas reducing device.
Figure 9B:
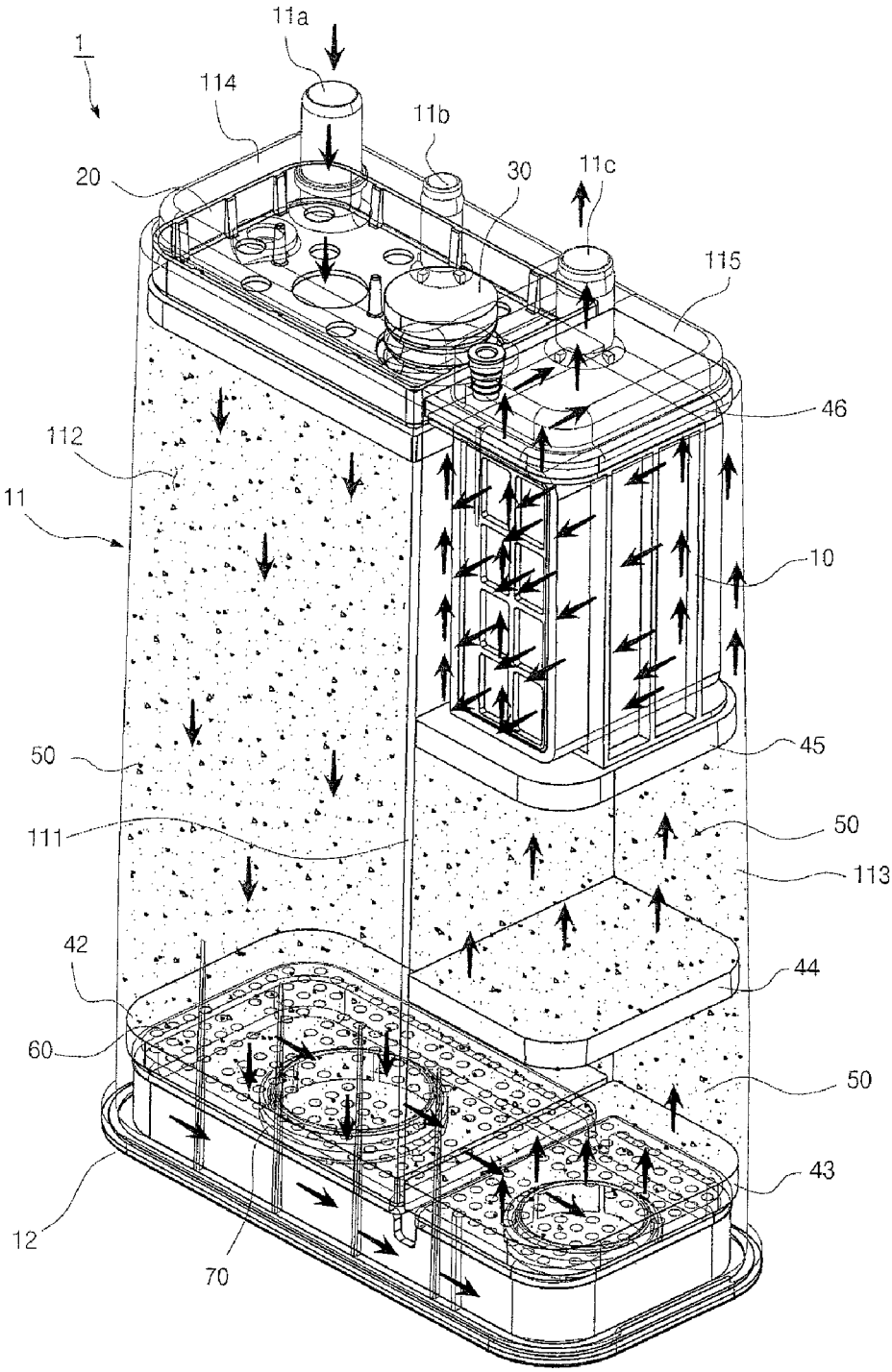

Hereafter, the operation of the canister with a fuel gas reducing device, constructed as mentioned above, will be described with reference to FIGS. 8, 9A and 9B. FIG. 8 is a systematic view schematically illustrating the connection between the canister 1 with the fuel gas reducing device 10 according to the present invention and the fuel tank 2, and FIGS. 9A and 9B are projected perspective views explaining the fuel gas flow in the canister 1 with the fuel gas reducing device 10.

As described with reference to FIG. 1, when the engine is stopped, the liquid fuel stored in the fuel tank 2 vaporizes under the influence of the surrounding temperature, etc., and fuel gas is generated. As the fuel gas is generated, the internal pressure of the fuel tank 2 increases, and the vaporized fuel gas is introduced by the internal pressure into the tank port 11*a* of the canister 1 through an inlet pipe 3, which is connected to the fuel tank 2.

As in the conventional canister, the fuel gas introduced into the tank port 11*a* flows downwards through the first space 112, which is defined in the canister 1. Then, the fuel gas is introduced into the second space 113 through the second support filter 42, the inside space of the bottom plate 12, and the third support filter 43, and flows toward the fuel gas reducing device 10.

Meanwhile, as described above, the fuel gas reducing device 10 is formed with the windows 110*a* on opposite sides thereof, and the upper and lower horizontal plates 120*b* and 120*c* extend long distances in opposite directions and are brought into contact with the opposite inner surface portions of the canister body 11.

Therefore, the fuel gas, which flows upward through the second space 113, is changed in its flow direction at the fuel gas reducing device 10 so as to be perpendicular to the previous flow direction. Then, after the fuel gas flows through the inside of the fuel gas reducing device 10 in the horizontal direction, the fuel gas is changed again in its flow direction by 90° and discharged to the outside through the air port 11*c*.

When a driver starts the engine, as the pressure inside the throttle pipe 6 decreases, the control valve 7 is converted to an open state. Hence, as mentioned with respect to FIG. 1, outside air is introduced into the canister 1 through a discharge pipe 4 and the air port 11*c*, and flows into the throttle pipe 6 through the purge port 11*b* and a guide pipe 5 to thus be supplied to the engine.

In this procedure, air flow in the canister 1 occurs in a direction opposite that of the above-described procedure. In other words, the air introduced into the canister 1 through the air port 11*c* flows through the fuel gas reducing device 10 in the horizontal direction, passes through the second space 113, the inside space of the bottom plate 12 and the first space 112, and is discharged through the purge port 11*b*.

In the present embodiment, due to the use of the fuel gas reducing device 10, the air flow in the canister 1 cannot but be limited. Namely, in the conventional canister, the fuel gas, which is introduced into the canister through the tank port 11*a*, flows straight through the first space 112 and the second space 113 defined in the canister 1 and is discharged through the air port 11*c*. However, in the present embodiment, air flow is changed by 90° by the fuel gas reducing device 10, which is installed in the second space 113, by which smooth air flow is restrained. If the air flow in the canister 1 is restrained, the contact time between the activated charcoal 50 charged in the canister 1 and the fuel gas is extended, and according to this, the adsorption efficiency of the fuel gas by the activated charcoal 50 is improved.

Also, in the present embodiment, as the activated charcoal 50, which is charged between the first through fifth support filters 41 through 45 and in the fuel gas reducing device 10, for example, 2GK-N, BAX1110 and BWC are used. That is to say, various kinds of activated charcoal can be used together. If various kinds of activated charcoal are used, since the noxious substances not adsorbed by a certain kind of activated charcoal can be adsorbed by another kind of activated charcoal, the kinds and the amounts of the noxious gas discharged through the air port 11*c* can be remarkably reduced.

In the present embodiment, due to the fact that various kinds of activated charcoal are used and the fuel gas reducing device 10 is adopted, the flow of fuel gas is restrained, and the amount of fuel gas discharged from the canister 1 can be considerably reduced below the level which is required by the PZEV regulations.

As is apparent from the above description, according to the present invention, it is possible to realize a canister with a fuel gas reducing device which can significantly reduce the discharge of fuel gas.

Although a preferred embodiment of the present invention has been described for illustrative purposes, those skilled in the art will appreciate that various modifications, additions and substitutions are possible, without departing from the scope and spirit of the invention as disclosed in the accompanying claims.

For example, while it was described in the above embodiment that one fuel gas reducing device 10 is installed in the canister 1, it is conceivable that a plurality of fuel gas reducing devices 10 can be installed in the canister 1. Also, the installation position of the fuel gas reducing device 10 is not limited to the specified location, and therefore, the fuel gas reducing device 10 may be located in the first space 112 of the canister 1.

What is claimed is:

1. A canister for a motor vehicle, connected to a fuel tank and a throttle pipe to adsorb fuel gas containing noxious constituents, which are generated in a fuel tank, wherein a first space and a second space, through which the fuel gas flows, are defined, the fuel gas flows in opposite directions through the respective first and second spaces, the second space is divided into space parts by a plurality of support filters, a fuel gas reducing device is installed in one space part, which is delimited by two support filters, wherein the fuel gas reducing device has a fuel gas reducing block which is charged with activated charcoal and a bracket for holding said block, said block having windows for air flow in opposite sides thereof, wherein the bracket has upper and lower horizontal plates formed to be long in opposite directions, and air flow through the gas reducing device is perpendicular to air flow through the first and second spaces.

2. The canister according to claim 1, wherein the activated charcoal is charged in the fuel gas reducing device.

3. The canister according to claim 2, wherein ingredients of the activated charcoal, which is charged in the fuel gas reducing device, are different from those of activated charcoal, which is charged in the first and second spaces.

4. The canister according to claim 2, wherein BWC activated charcoal is charged in the fuel gas reducing device.

5. The canister according to claim 1, wherein the activated charcoal is charged in the fuel gas reducing block.

* * * * *